US008136300B2

(12) United States Patent
Lin

(10) Patent No.: US 8,136,300 B2
(45) Date of Patent: Mar. 20, 2012

(54) WINDOW OR DOOR FRAME HAVING BRACE DEVICE

(75) Inventor: Ching Tien Lin, Taipei Hsien (TW)

(73) Assignee: Thase Enterprise Co., Ltd., Sinjhuang, Taipei Hsien (TW)

( * ) Notice: Subject to any disclaimer, the term of this patent is extended or adjusted under 35 U.S.C. 154(b) by 404 days.

(21) Appl. No.: 12/583,909

(22) Filed: Aug. 27, 2009

(65) Prior Publication Data

US 2011/0049912 A1 Mar. 3, 2011

(51) Int. Cl.
*E06B 5/00* (2006.01)

(52) U.S. Cl. ..... 49/356; 52/210; 292/219

(58) Field of Classification Search ..... 49/365, 49/366, 394, 504, 505; 292/194, 195, 197, 292/198, 200, 202, 203, 207, 340; 70/91, 70/101

See application file for complete search history.

(56) References Cited

U.S. PATENT DOCUMENTS 4,644,696 A * 2/1987 Bursk ..... 49/367
5,435,102 A * 7/1995 McCarthy ..... 49/365
5,450,697 A * 9/1995 Prucinsky et al. ..... 52/210
5,471,792 A * 12/1995 Higgins et al. ..... 49/365
5,765,309 A * 6/1998 Mamchych ..... 49/365
5,794,382 A * 8/1998 Prucinsky ..... 49/365
5,850,710 A 12/1998 Brock
5,890,319 A * 4/1999 Haeck et al. ..... 49/365
5,941,023 A * 8/1999 Mamchych ..... 49/365
6,000,733 A 12/1999 Linder
6,131,338 A * 10/2000 Haeck et al. ..... 49/365
6,427,387 B1 * 8/2002 Hunt ..... 49/365
6,968,658 B2 * 11/2005 Hales ..... 52/210
7,000,355 B2 * 2/2006 Flory et al. ..... 49/365

* cited by examiner

*Primary Examiner* — Jerry Redman
*Assistant Examiner* — Justin Rephann
(74) *Attorney, Agent, or Firm* — Charles E. Baxley

(57) ABSTRACT

A frame includes a seat attached to a lower beam, and an anchor attached to an upper beam and having a pivotal catch tongue, a tubular member has a lower portion detachably engaged with the seat and having an upper latch shaft for engaging with the catch tongue and for detachably locking the latch shaft and the tubular member to the anchor, a follower is slidably attached to the tubular member for disengaging the catch tongue from the latch shaft, a lock device is secured to the tubular member and includes an actuating shank having a rocker arm for moving the follower to disengage the catch tongue from the latch shaft, and for preventing the tubular member from being disengaged from the anchor by unauthorized persons.

7 Claims, 9 Drawing Sheets

WINDOW OR DOOR FRAME HAVING BRACE DEVICE

BACKGROUND OF THE INVENTION

1. Field of the Invention

The present invention relates to a window or door frame, and more particularly to a window or door frame including a brace member or device attached to the window or door frame and lockable to the frame for separating the window or door frame into two separated frame sections.

2. Description of the Prior Art

Typical windows or doors comprise a single window or door panel pivotally attached to a window or door frame for controlling the access through the window or door frame.

For example, U.S. Pat. No. 5,850,710 to Brock, and U.S. Pat. No. 6,000,733 to Linder disclose two of the typical escape windows or exit doors each also comprising a single window or door panel pivotally attached to a window or door frame.

Normally, the side braces or jambs of the window or door frame are solidly secured together with upper and lower bracing members, and may not be disengaged from the window or door frame.

For wider window or door frames, one or more brace members or devices are required to be attached or mounted to the middle portion of the window or door frame for separating the wider window or door frame into two or more separated frame sections and for pivotally attaching two or more window or door panels to the frame sections respectively.

However, normally, the brace members or devices are latched to the window or door frame and may be easily disengaged from the window or door frame by unauthorized persons.

The present invention has arisen to mitigate and/or obviate the afore-described disadvantages of the conventional window or door frames.

SUMMARY OF THE INVENTION

The primary objective of the present invention is to provide a window or door frame including a brace member or device attached to the window or door frame and lockable to the frame for separating the window or door frame into two separated frame sections.

In accordance with one aspect of the invention, there is provided a frame comprising an upper beam and a lower beam, a seat attached to the lower beam and including a projection extended upwardly from the seat, an anchor attached to the upper beam and including a catch tongue pivotally attached to the anchor with a pivot axle, a spring member engaged with the catch tongue for biasing the catch tongue, a tubular member including a lower portion having an opening for receiving and engaging with the projection of the seat and for detachably anchoring and mounting the lower portion of the tubular member to the seat of the lower beam, the tubular member including a latch shaft attached to an upper portion of the tubular member for selectively engaging with the catch tongue and for pivoting the catch tongue until the latch shaft is moved over the catch tongue, and the spring member biasing the catch tongue to engage with the latch shaft and to latch and lock the latch shaft and the upper portion of the tubular member to the anchor and the upper beam after the latch shaft is moved over the catch tongue, and the tubular member including a chamber formed in the upper portion of the tubular member, a casing engaged in the chamber of the tubular member and secured to the tubular member, a lock device secured to the upper portion of the tubular member and engaged into the casing, and including an actuating shank extended therefrom, a follower slidably attached to the casing and including an actuating end to be moved toward and away from the catch tongue for selectively disengaging the catch tongue from the latch shaft and for allowing the latch shaft and the upper portion of the tubular member to be disengaged from the upper anchor selectively, a rocker arm attached to the actuating shank and rotated in concert with the actuating shank, and including at least one actuating end for engaging with the follower and for moving the actuating end of the follower to engage with the catch tongue and to selectively disengage the catch tongue from the latch shaft, and a key engageable with the lock device for selectively actuating and rotating the actuating shank of the lock device and the rocker arm to engage with the catch tongue and to disengage the catch tongue from the latch shaft.

The seat includes an inclined surface formed on the projection for facilitating an engagement of the lower portion of the tubular member to the seat.

The casing includes a guide pin, and the follower includes an oblong hole formed therein for slidably engaging with the guide pin and for guiding the follower to move relative to the casing and the tubular member.

The casing includes a lock ring attached to the guide pin and engaged with the follower for anchoring and retaining the follower to the casing and the tubular member and for preventing the follower from being disengaged from the casing and the tubular member.

The casing includes at least one spring member engaged with the follower for biasing and disengaging the actuating end of the follower from the catch tongue.

The casing includes a front wall having an extension extended therefrom, and the spring member is engaged between the extension of the front wall of the casing and the follower for biasing the actuating end of the follower from the catch tongue.

The casing includes a cover mounted to the tubular member for covering the chamber of the tubular member and for shielding and protecting the follower and the rocker arm, and for retaining the casing and the follower and the rocker arm within the chamber of the tubular member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
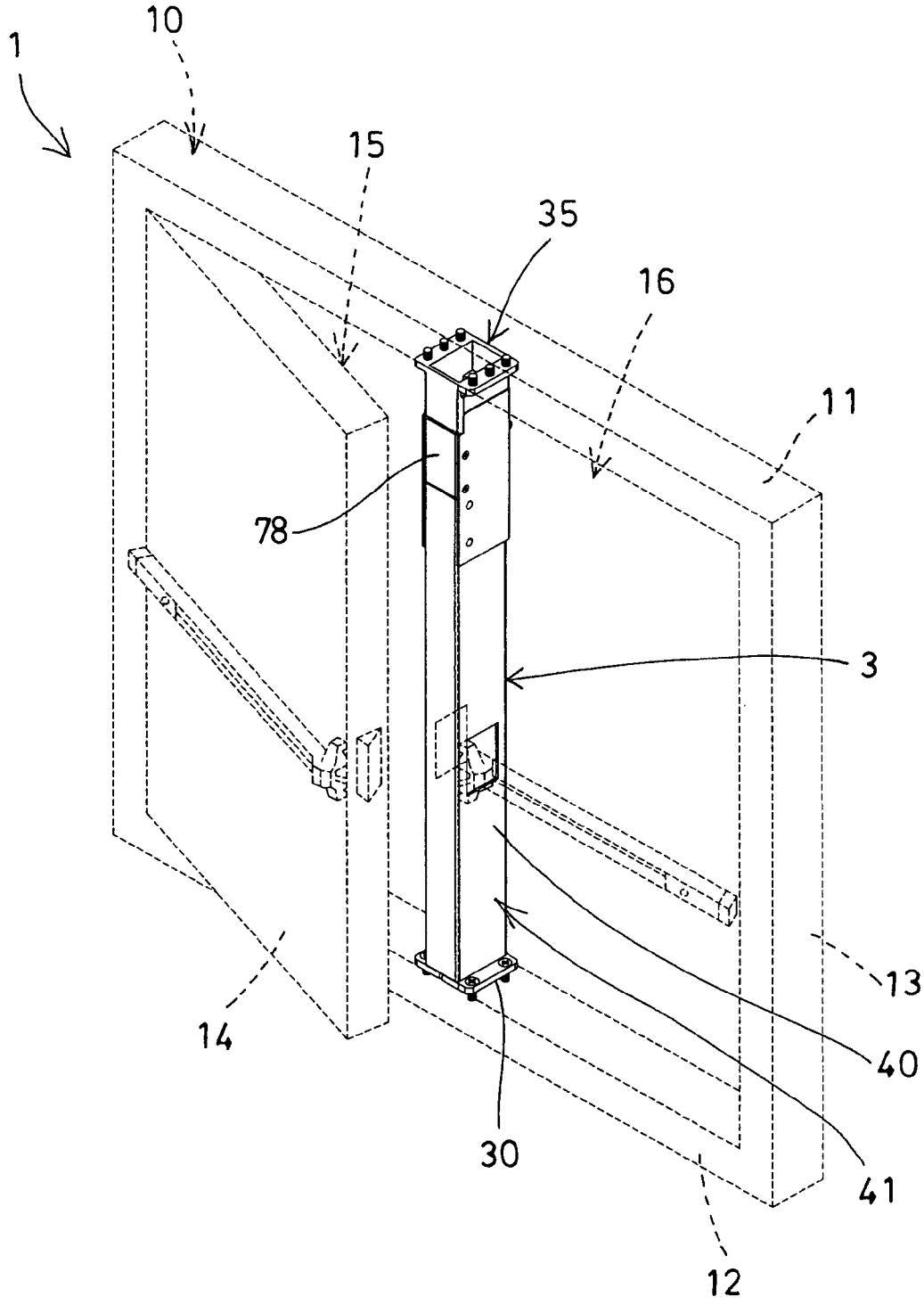
FIG. 1 is a perspective view of a window or door frame including a brace member or device in accordance with the present invention.
Figure 2:
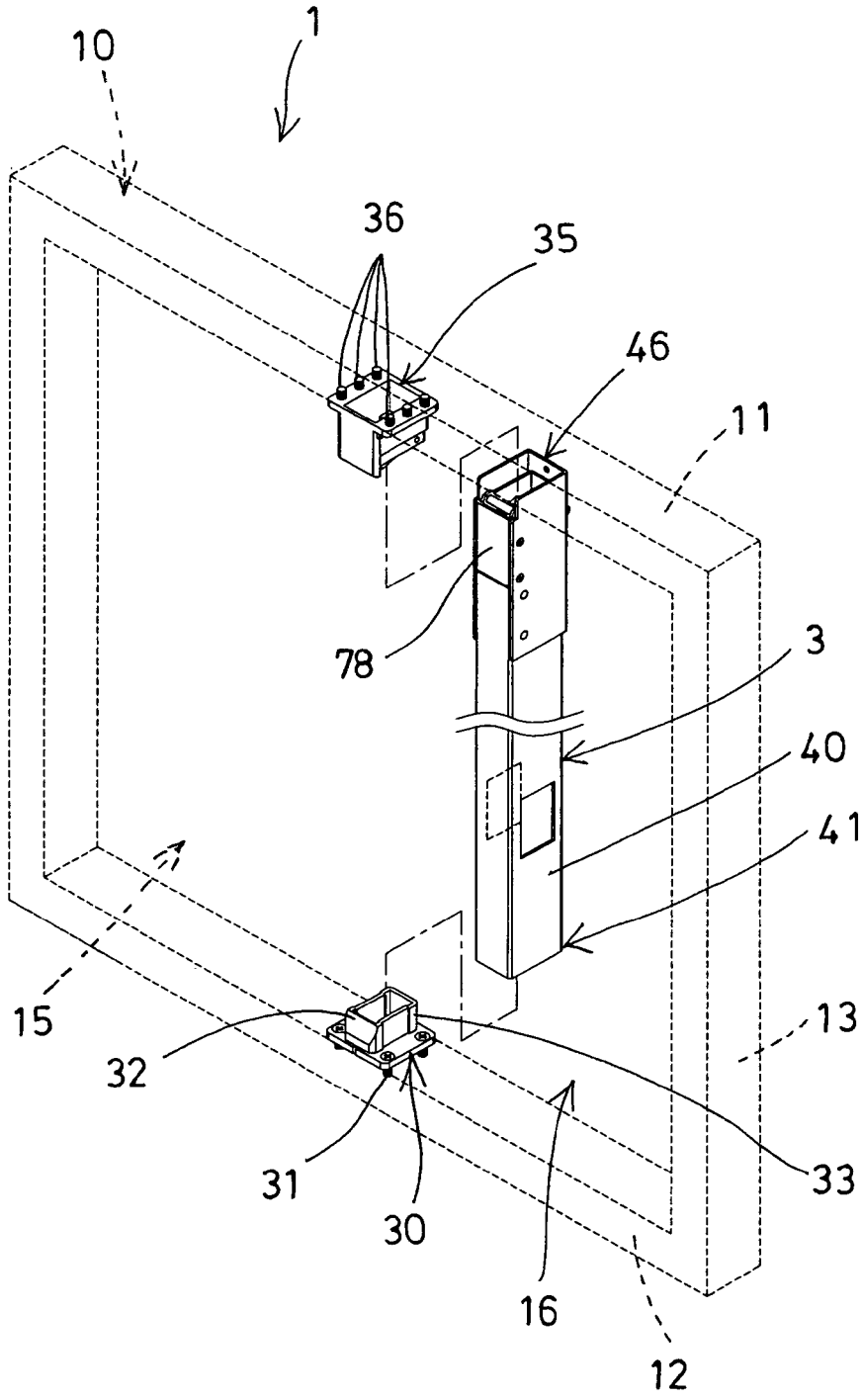
FIG. 2 is a partial exploded view of the brace member or device for the window or door frame.

Referring to the drawings, and initially to FIGS. 1 and 2, a window or door apparatus 1 in accordance with the present invention comprises a substantially square or rectangular frame member 10 including an upper beam 11, a lower beam 12, and two side jambs or beams 13 secured between the upper and the lower beams 11, 12, for attaching two or more window or door panels 14 to the frame member 10. The window or door apparatus 1 may be selected from the sliding doors, pivotal doors, fire or escape or emergency doors, or the like. The above-described structure is typical and will not be described in further details.

The window or door apparatus 1 comprises one or more brace members or devices 3 attached to the window or door frame member 10 and lockable to the frame member 10 for separating the window or door frame member 10 into two or more separated frame sections 15, 16 and for receiving or attaching or anchoring the window or door panels 14 respectively. For illustration purposes, only one of the brace members or devices 3 is shown in the drawings, but two or more brace members or devices 3 may be selectively attached to the window or door frame member 10 dependent on the wider dimension of the window or door frame member 10.

As shown in FIGS. 1-4, the brace device 3 includes a lower seat 30 attached or secured to the lower beam 12 with latches or fasteners 31, and includes an inclined surface 32 formed or provided on an upper projection 33 of the lower seat 30 that is extended upwardly from the lower seat 30, such as formed in the front portion 34 of the upper projection 33 of the lower seat 30, and includes an upper anchor 35 attached or secured to the upper beam 11 with latches or fasteners 36, and includes a catch tongue 37 (FIGS. 3-9) pivotally attached or coupled or secured or mounted to the lower portion of the upper anchor 35 with a pivot axle 38, and a spring member 39 attached to the pivot axle 38 and engaged with the catch tongue 37 for biasing the catch tongue 37 downwardly.

Figure 3:
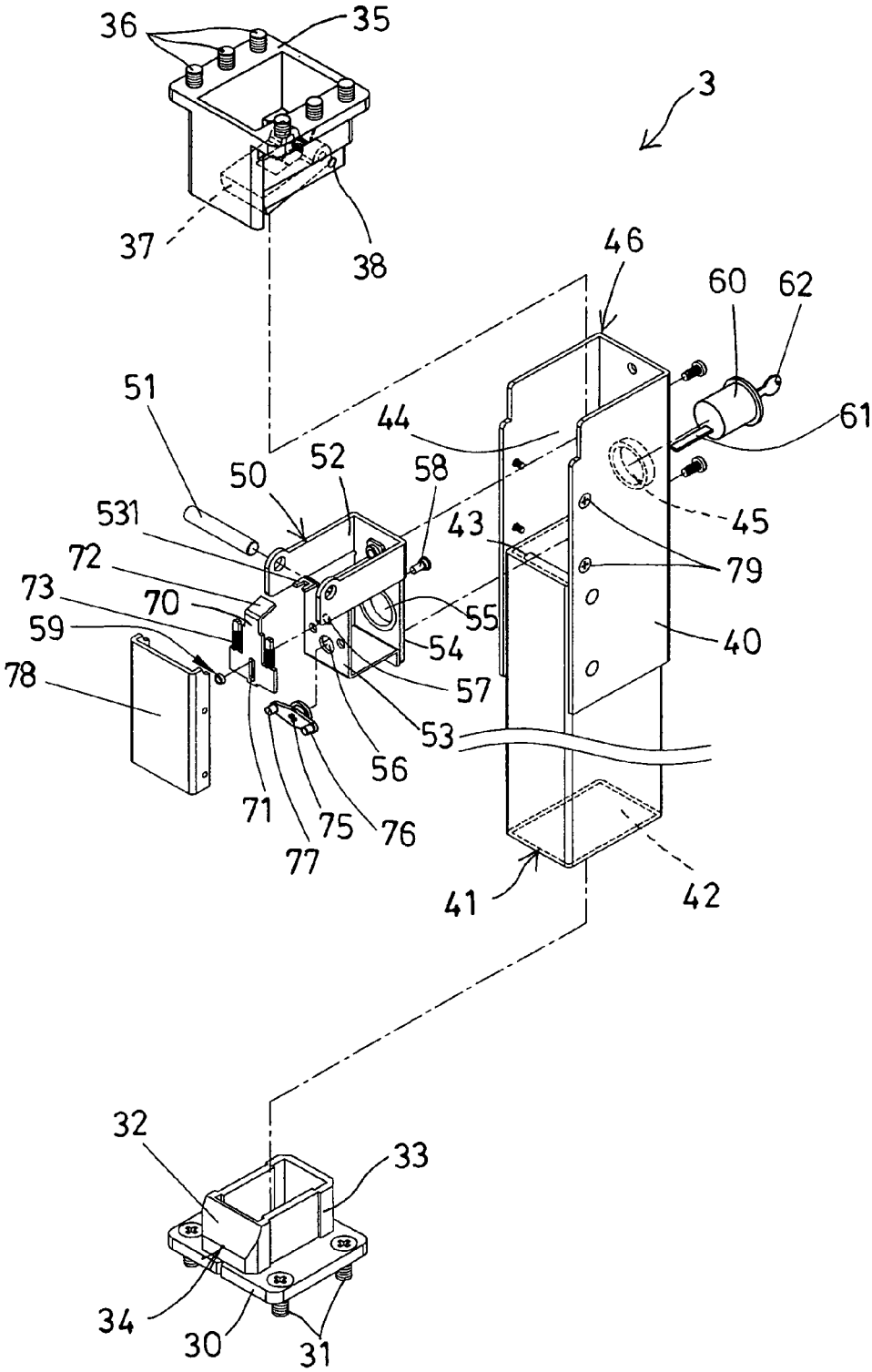
FIG. 3 is another partial exploded view of the brace member or device.
Figure 4:
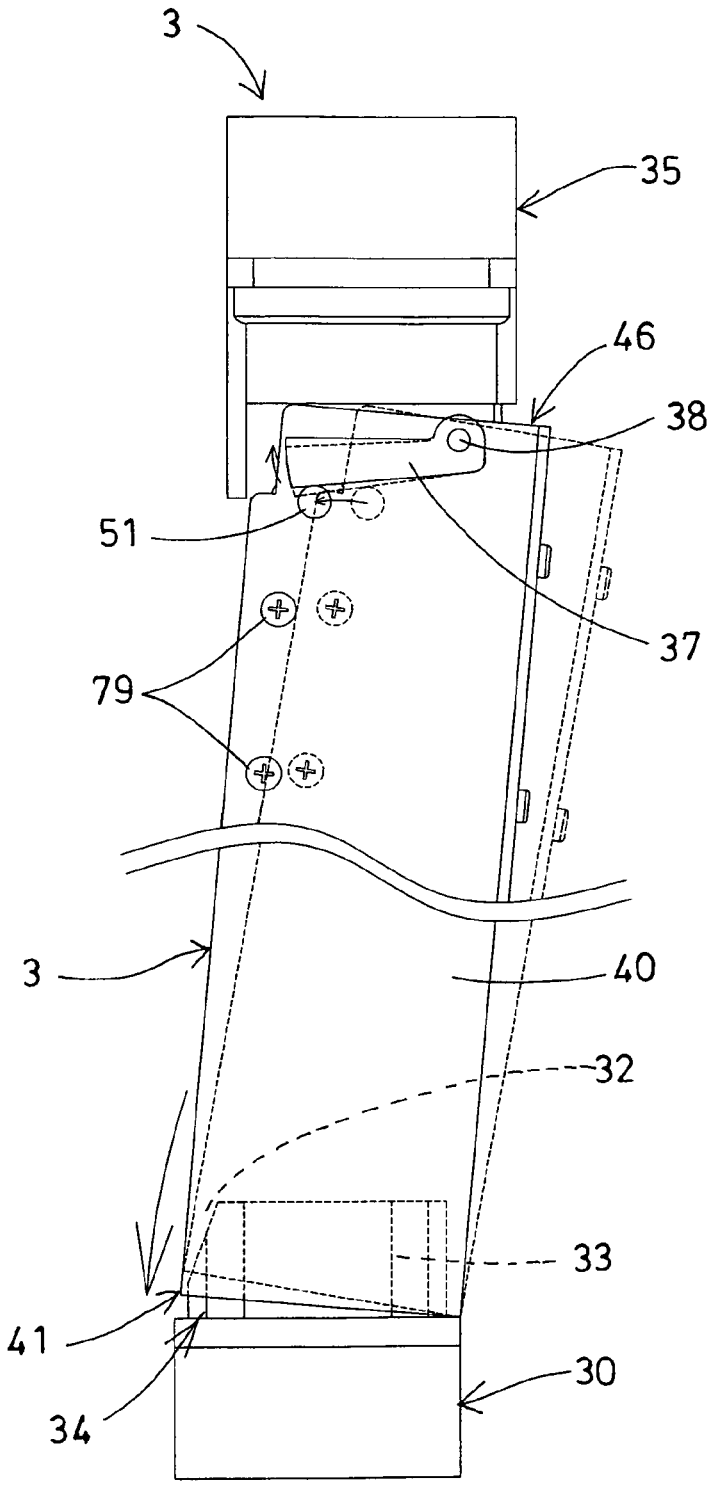
FIG. 4 is a side plan schematic view illustrating the assembling of the brace member or device for the window or door frame.

The brace device 3 further includes a longitudinal and/or tubular member 40 having an opening 42 formed in the lower portion 41 thereof for receiving or engaging with the upper projection 33 of the lower seat 30 and for solidly and detachably anchoring or attaching or securing or mounting the lower portion 41 of the tubular member 40 to the lower seat 30, for example, as shown in FIGS. 2-4, when it is required to attach the tubular member 40 to the lower seat 30, it is only required to tilt the tubular member 40 and to engage or contact the lower portion 41 of the tubular member 40 with the rear portion of the projection 33 of the lower seat 30 (FIG. 4), and then to erect the tubular member 40 to have the projection 33 engaged into the lower opening 42 of the tubular member 40.

The tubular member 40 further includes a partition 43 formed or provided in the middle portion of the tubular member 40 for forming a chamber 44 in the upper portion 46 of the tubular member 40, and includes a passage 45 formed in the upper portion 46 thereof and communicative with the chamber 44 of the tubular member 40, a casing 50 is received and engaged in the chamber 44 of the tubular member 40 and secured to the tubular member 40 with a latch shaft 51 which is engaged through both the casing 50 and the tubular member 40 for solidly securing the casing 50 and the tubular member 40 together and for solidly attaching the latch shaft 51 to the upper portion 46 of the tubular member 40.

Figure 5:
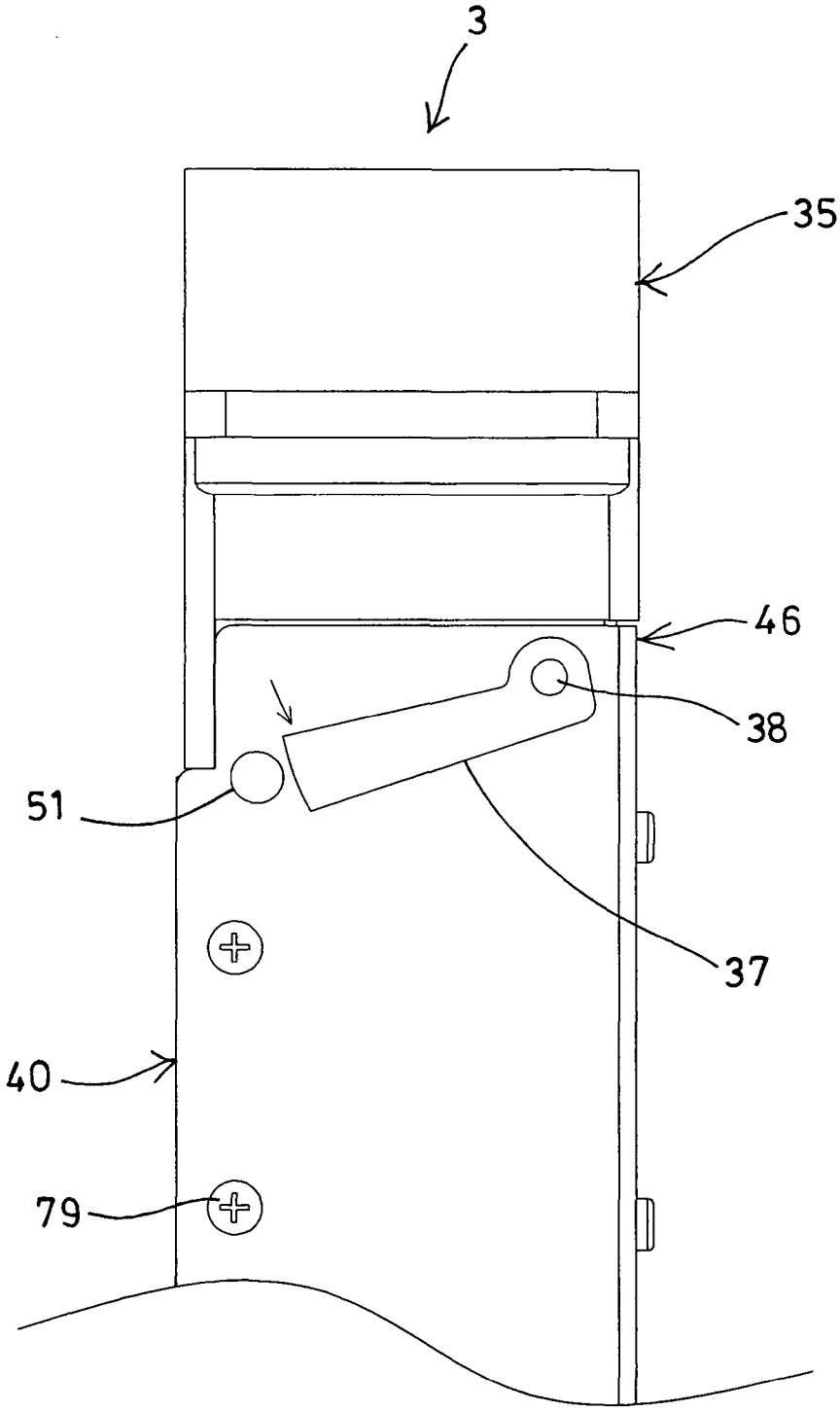
FIG. 5 is an enlarged partial side plan schematic view illustrating the operation of the window or door frame.

In operation, as shown in FIG. 4, when the upper portion 46 of the tubular member 40 is moved toward the upper anchor 35, the latch shaft 51 may be forced to engage with the catch tongue 37 and to move or force or pivot the catch tongue 37 upwardly against the spring member 39. When the latch shaft 51 is moved or passed over the catch tongue 37, as shown in FIG. 5, the spring member 39 may bias or force or pivot the catch tongue 37 downwardly again to engage with the latch shaft 51 and to anchor or position or lock the latch shaft 51 and thus the upper portion 46 of the tubular member 40 to the upper anchor 35, and to easily and quickly attach and lock the tubular member 40 between the lower seat 30 and the upper anchor 35.

Figure 6:
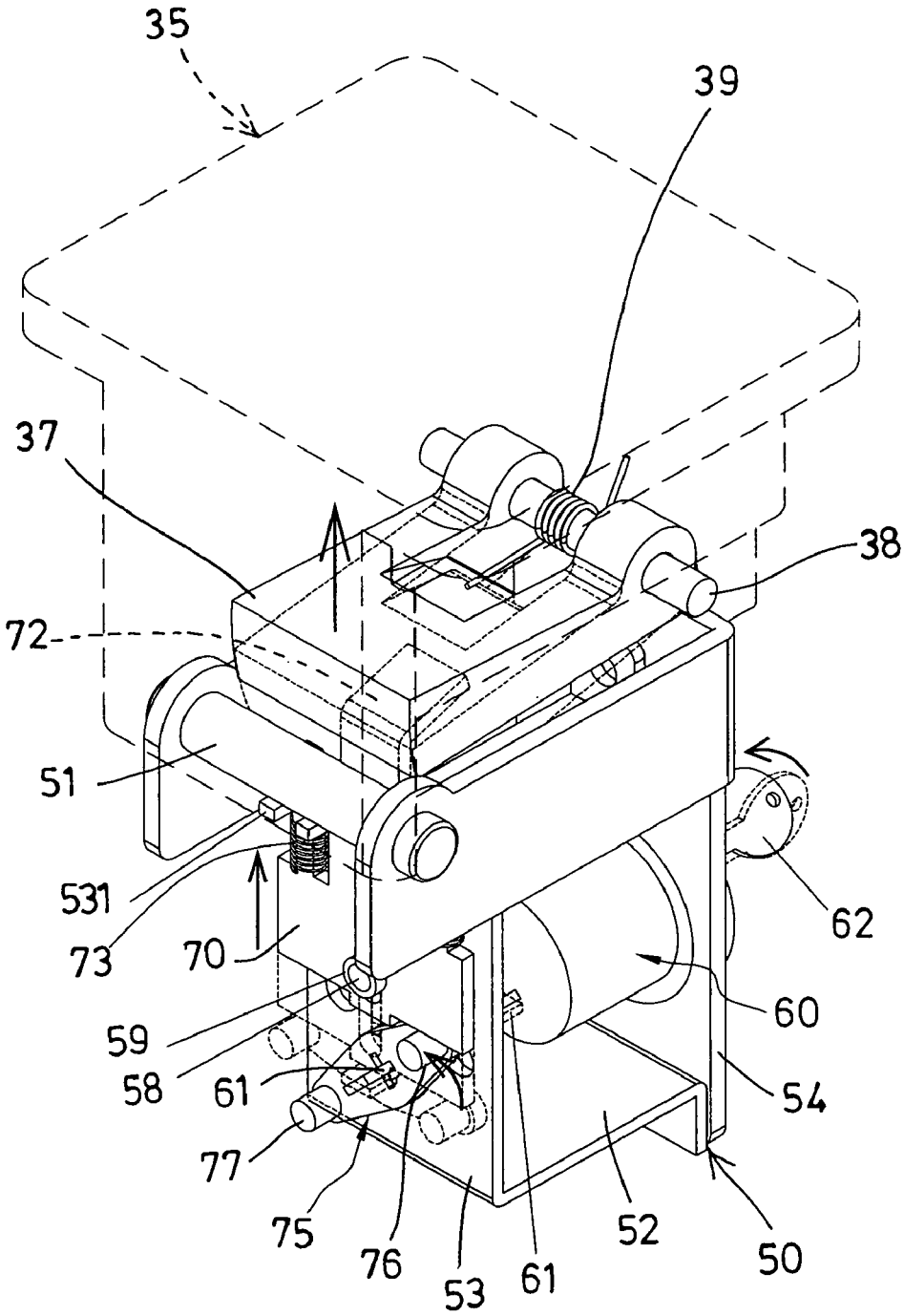
FIG. 6 is a partial perspective view of the brace member or device for the window or door frame.

As shown in FIGS. 3 and 6, the casing 50 includes a compartment 52 formed therein and defined between a front wall 53 and a rear wall 54, and includes a pathway 55 formed in the rear wall 54 and communicative with the compartment 52 of the casing 50 and aligned with the passage 45 of the tubular member 40 for receiving or engaging with a lock device 60 which is secured to or engaged into the upper portion 46 of the tubular member 40 and/or the casing 50 and which includes an actuating shank 61 extended therefrom, a key 62 (FIGS. 3, 6, 8) may be engaged with the lock device 60 for selectively actuating and rotating the actuating shank 61. The casing 50 further includes an orifice 56 formed in the front wall 53 for rotatably receiving or engaging with the actuating shank 61, and includes an aperture 57 also formed in the front wall 53 for receiving or engaging with a guide pin 58.

Figure 7:
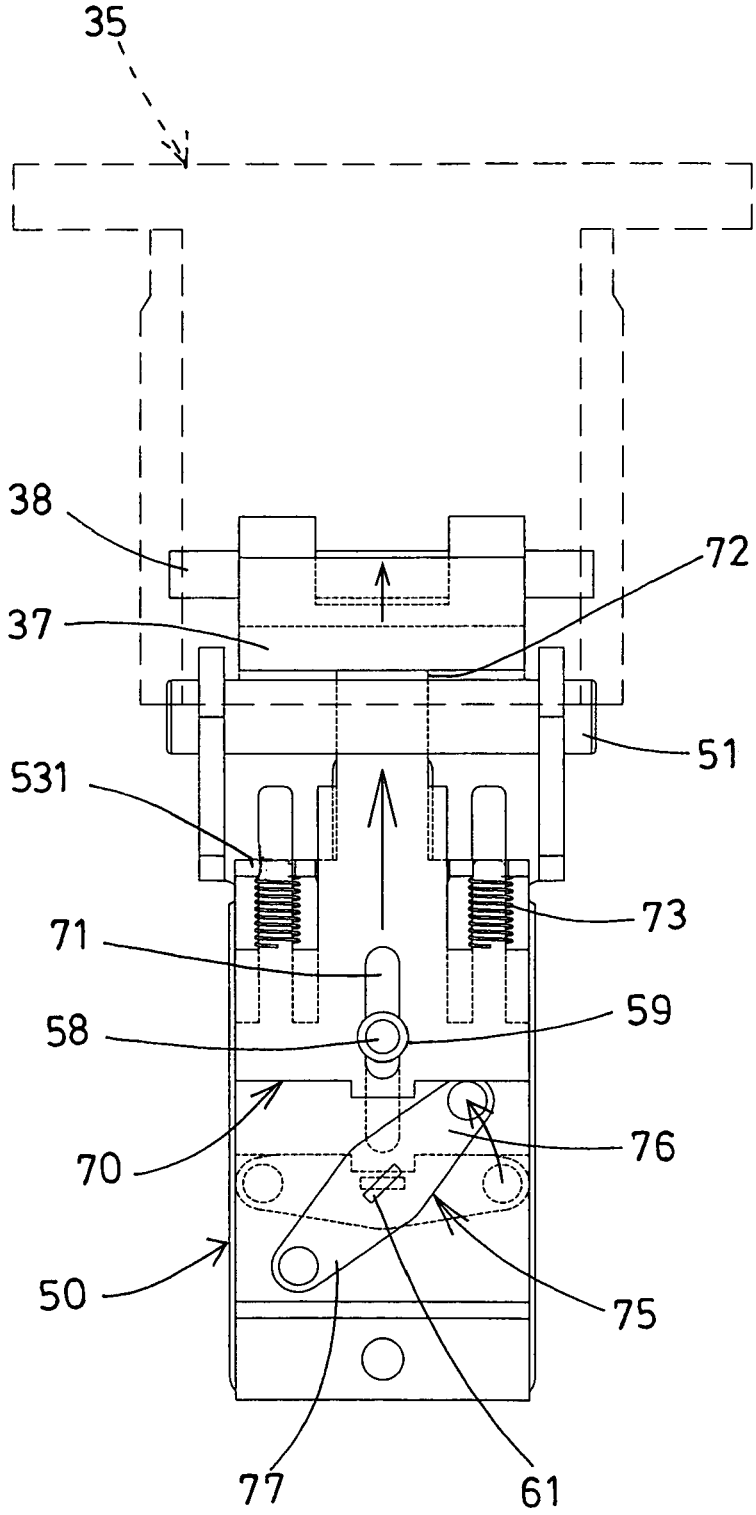
FIG. 7 is a front plan schematic view of the brace member or device as shown in FIG. 6.
Figure 8:
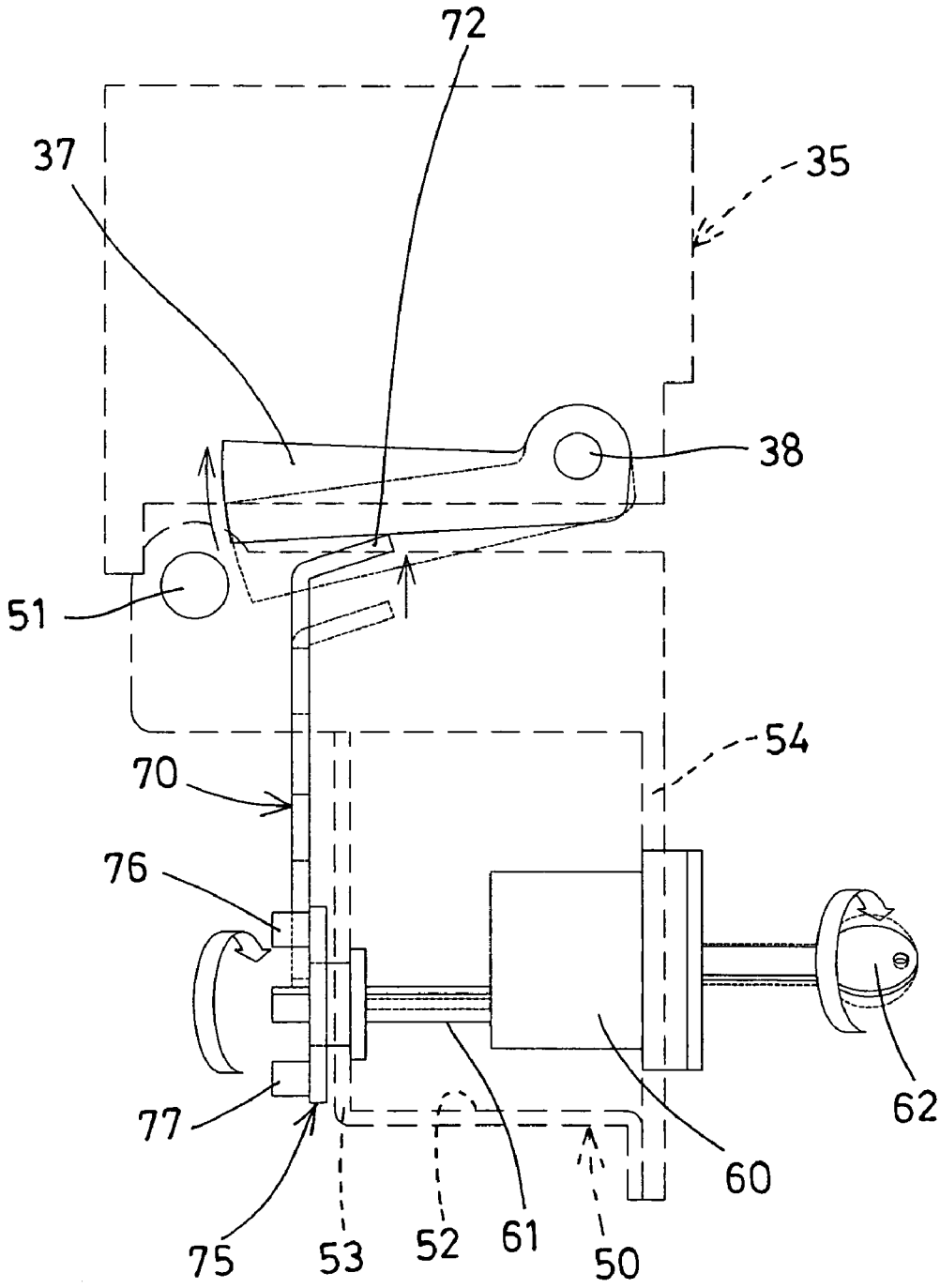
FIG. 8 is a partial side plan schematic view illustrating the operation of the window or door frame.
Figure 9:
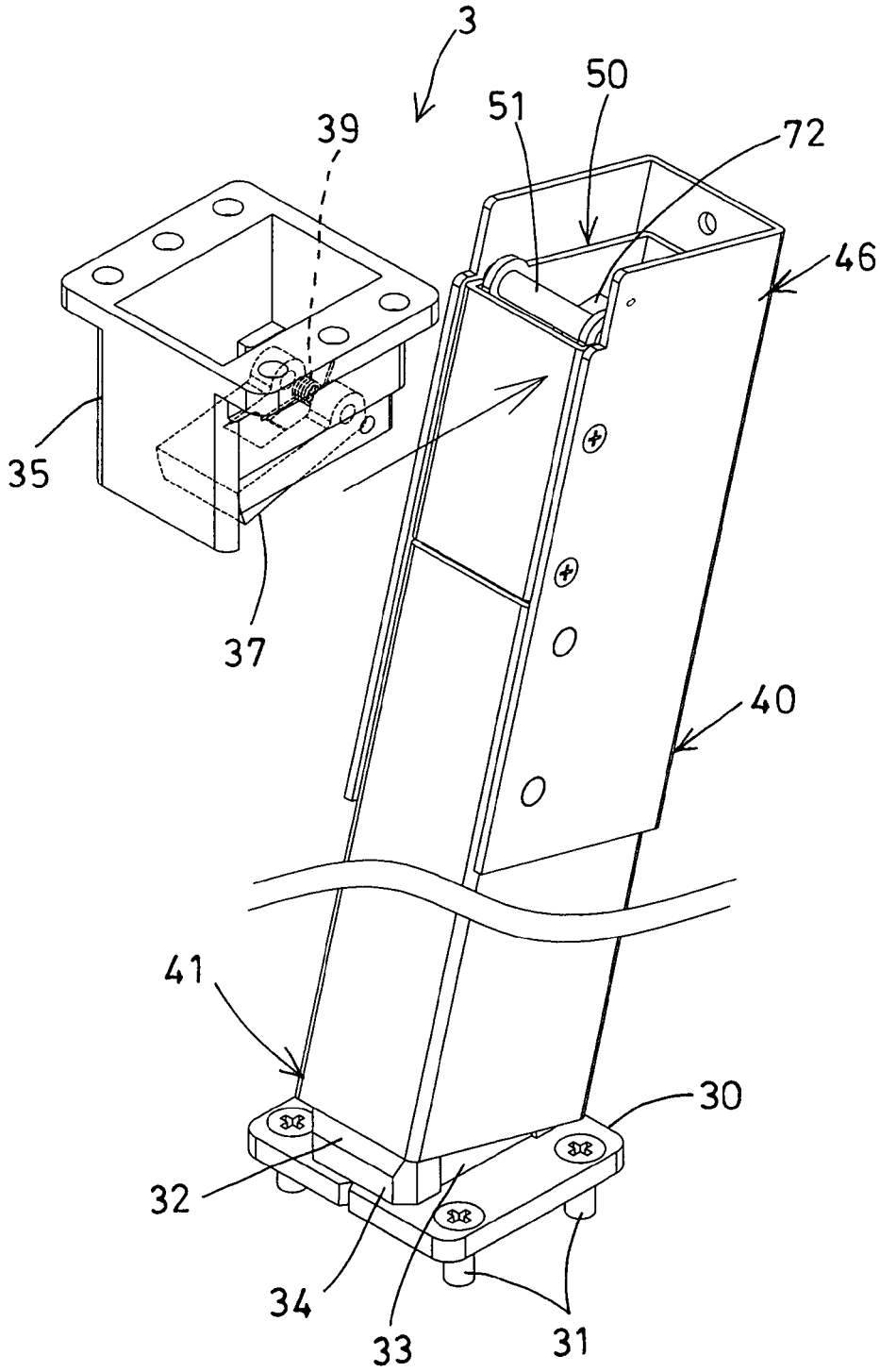
FIG. 9 is a partial exploded view illustrating the disengagement or detachment of the brace member or device from the window or door frame.

A slide or follower 70 is slidably attached or mounted to the casing 50, such as attached or mounted to the front wall 53 of the casing 50, and includes an oblong hole 71 formed therein for slidably receiving or engaging with the guide pin 58 (FIG. 7) and for guiding the follower 70 to move up and down relative to the casing 50 and the tubular member 40, and for allowing an upper actuating end 72 of the follower 70 (FIGS. 3, 6-9) to move upwardly toward or away from the catch tongue 37. In operation, as shown in FIG. 8, when the upper actuating end 72 of the follower 70 is moved upwardly toward the catch tongue 37, the catch tongue 37 may be caused to pivot or rotate upwardly with the pivot axle 38 and may be disengaged from the latch shaft 51, and thus for allowing the latch shaft 51 and the upper portion 46 of the tubular member 40 to be disengaged or moved away from the upper anchor 35 (FIG. 9).

It is preferable that a gasket or lock ring 59 (FIGS. 3, 6-7) is attached or mounted to the guide pin 58 and engaged with the follower 70 for stably anchoring and retaining the follower 70 to the casing 50 and the tubular member 40, and for preventing the follower 70 from being disengaged from the casing 50 and the tubular member 40. As shown in FIGS. 3 and 6-7, one or more spring members 73 may further be provided and engaged with the casing 50 and the follower 70, such as engaged between the extensions 531 that are extended from the front wall 53 of the casing 50 and the follower 70 for biasing the follower 70 to move downwardly relative to the casing 50 and the tubular member 40 and to disengage the upper actuating end 72 of the follower 70 from the catch tongue 37.

A rocker arm 75 is attached or secured or mounted to the actuating shank 61 and rotated in concert with the actuating shank 61, and includes two actuating ends 76, 77 for engaging with the follower 70 (FIGS. 6-8) and for moving the follower 70 upwardly against the spring members 73 and for moving or causing the upper actuating end 72 of the follower 70 to move upwardly to engage with the catch tongue 37 and to disengage the catch tongue 37 from the latch shaft 51, and thus for allowing the latch shaft 51 and the upper portion 46 of the tubular member 40 to be disengaged or moved away from the upper anchor 35 (FIG. 9), and thus for allowing the tubular member 40 to be easily and quickly attached and mounted to or disengaged from the lower seat 30 and the upper anchor 35 and the frame member 10.

A cover 78 may further be provided and attached or secured or mounted to the tubular member 40 with latches or fasteners 79 for covering or blocking or shielding the chamber 44 of the tubular member 40 and for shielding or protecting the follower 70 and the rocker arm 75, and/or for stably retaining the casing 50 and the follower 70 and the rocker arm 75 within the chamber 44 of the tubular member 40, and/or for preventing the follower 70 and the rocker arm 75 from being exposed, and/or for preventing the follower 70 and the rocker arm 75 from being interfered by the other objects.

In operation, as shown in FIGS. 1 and 2, the lower seat 30 and the upper anchor 35 of the brace device 3 may first be attached or secured to the lower beam 12 and the upper beam 11 respectively, the lower portion 41 of the tubular member 40 may then be engaged onto the projection 33 of the lower seat 30 (FIG. 4), and then the upper portion 46 of the tubular member 40 may then be moved toward the upper anchor 35 to have the latch shaft 51 engaged with the catch tongue 37 and to move or force the catch tongue 37 upwardly against the spring member 39, after the latch shaft 51 is moved or passed over the catch tongue 37, the spring member 39 may bias the catch tongue 37 to engage with the latch shaft 51 and to anchor or lock the latch shaft 51 and the upper portion 46 of the tubular member 40 to the upper anchor 35 (FIG. 5), and to easily and quickly attach and lock the tubular member 40 between the lower seat 30 and the upper anchor 35.

When it is required to detach or disengage the tubular member 40 from the lower seat 30 and the upper anchor 35, a key 62 is required to be engaged with the lock device 60 in order to actuate and rotate the actuating shank 61 and the rocker arm 75, and to actuate and move the upper actuating end 72 of the follower 70 upwardly toward and to engage with the catch tongue 37, the catch tongue 37 may then be caused to pivot or rotate upwardly with the pivot axle 38 and may be disengaged from the latch shaft 51 for allowing the latch shaft 51 and the upper portion 46 of the tubular member 40 to be disengaged or moved away from the upper anchor 35 (FIG. 9), and thus for allowing the tubular member 40 to be easily and quickly disengaged from the lower seat 30 and the upper anchor 35. Without the key 62, the tubular member 40 may not be disengaged from the lower seat 30 and the upper anchor 35 by unauthorized persons.

Accordingly, the window or door frame in accordance with the present invention includes a brace member or device attached to the window or door frame and lockable to the frame for separating the window or door frame into two separated frame sections.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A frame comprising:

an upper beam and a lower beam, a seat attached to said lower beam and including a projection extended upwardly from said seat, an anchor attached to said upper beam and including a catch tongue pivotally attached to said anchor with a pivot axle, a spring member engaged with said catch tongue for biasing said catch tongue, a tubular member including a lower portion having an opening for receiving and engaging with said projection of said seat and for detachably anchoring and mounting said lower portion of said tubular member to said seat of said lower beam, said tubular member including a latch shaft attached to an upper portion of said tubular member for selectively engaging with said catch tongue and for pivoting said catch tongue until said latch shaft is moved over said catch tongue, and said spring member biasing said catch tongue to engage with said latch shaft and to latch and lock said latch shaft and said upper portion of said tubular member to said anchor and said upper beam after said latch shaft is moved over said catch tongue, and said tubular member including a chamber formed in said upper portion of said tubular member, a casing engaged in said chamber of said tubular member and secured to said tubular member, a lock device secured to said upper portion of said tubular member and engaged into said casing, and including an actuating shank extended therefrom, a follower slidably attached to said casing and including an actuating end to be moved toward and away from said catch tongue for selectively disengaging said catch tongue from said latch shaft and for allowing said latch shaft and said upper portion of said tubular member to be disengaged from said upper anchor selectively, a rocker arm attached to said actuating shank and rotated in concert with said actuating shank, and including at least one actuating end for engaging with said follower and for moving said actuating end of said follower to engage with said catch tongue and to selectively disengage said catch tongue from said latch shaft, and a key engageable with said lock device for selectively actuating and rotating said actuating shank of said lock device and said rocker arm to engage with said catch tongue and to disengage said catch tongue from said latch shaft.

2. The frame as claimed in claim 1, wherein said seat includes an inclined surface formed on said projection for facilitating an engagement of said lower portion of said tubular member to said seat.

3. The frame as claimed in claim 1, wherein said casing includes a guide pin, and said follower includes an oblong hole formed therein for slidably engaging with said guide pin and for guiding said follower to move relative to said casing and said tubular member.

4. The frame as claimed in claim 3, wherein said casing includes a lock ring attached to said guide pin and engaged with said follower for anchoring and retaining said follower to said casing and said tubular member and for preventing said follower from being disengaged from said casing and said tubular member.

5. The frame as claimed in claim 1, wherein said casing includes at least one spring member engaged with said follower for biasing and disengaging said actuating end of said follower from said catch tongue.

6. The frame as claimed in claim 5, wherein said casing includes a front wall having an extension extended therefrom, and said at least one spring member is engaged between said extension of said front wall of said casing and said follower.

7. The frame as claimed in claim 1, wherein said casing includes a cover mounted to said tubular member for covering said chamber of said tubular member and for shielding and protecting said follower and said rocker arm, and for retaining said casing and said follower and said rocker arm within said chamber of said tubular member.

* * * * *